US006845713B1

(12) United States Patent
Schumann et al.

(10) Patent No.: US 6,845,713 B1
(45) Date of Patent: Jan. 25, 2005

(54) DEVICE FOR REGISTERING A PRINTING PLATE POSITION

(75) Inventors: Frank Schumann, Heidelberg (DE); Karl Wispeintner, Ortenburg (DE); Thomas Wolf, Karlsruhe (DE)

(73) Assignee: Heidelberger Druckmaschinen AG, Heildelberg (DE)

( * ) Notice: Subject to any disclaimer, the term of this patent is extended or adjusted under 35 U.S.C. 154(b) by 0 days.

(21) Appl. No.: 09/472,054

(22) Filed: Dec. 23, 1999

(30) Foreign Application Priority Data

Dec. 23, 1998 (DE) ..... 198 59 632

(51) Int. Cl.[7] ..... B41L 3/02

(52) U.S. Cl. ..... 101/477; 101/DIG. 36; 101/415.1; 33/617

(58) Field of Search ..... 101/477, DIG. 36, 101/415.1, 216, 485, 484, 409, 410, 383, 378; 33/617, 619, 620, 621

(56) References Cited

U.S. PATENT DOCUMENTS

| | | | | |
|---|---|---|---|---|
| 4,596,468 A | | 6/1986 | Simeth | |
| 4,603,641 A | * | 8/1986 | Jeschke et al. | 101/415.1 |
| 4,845,433 A | * | 7/1989 | Kleinberg et al. | 324/338 |
| 5,320,041 A | * | 6/1994 | Maejima et al. | 101/415.1 |
| 5,383,402 A | | 1/1995 | Takano et al. | |
| 5,394,614 A | * | 3/1995 | Lindner et al. | 33/621 |
| 5,461,980 A | * | 10/1995 | Maejima et al. | 101/415.1 |
| 5,479,859 A | * | 1/1996 | Lindner et al. | 101/485 |
| 5,555,810 A | * | 9/1996 | Stiel | 101/477 |
| 5,778,779 A | * | 7/1998 | Jones et al. | 101/216 |
| 5,806,424 A | * | 9/1998 | Elliot | 101/127.1 |
| 5,806,431 A | * | 9/1998 | Muth | 101/486 |
| 5,868,072 A | * | 2/1999 | Nishi | 101/415.1 |
| 5,918,540 A | * | 7/1999 | Fischer | 101/128.4 |
| 5,992,325 A | * | 11/1999 | Schumann et al. | 101/477 |
| 6,053,105 A | * | 4/2000 | Rudzewitz | 101/477 |
| 6,135,027 A | * | 10/2000 | Rudzewitz et al. | 101/415.1 |

FOREIGN PATENT DOCUMENTS

| | | |
|---|---|---|
| DE | 7 312 511 | 9/1973 |
| DE | 30 00 576 A1 | 7/1981 |
| DE | 31 36 701 C1 | 4/1983 |
| DE | 34 38 931 C2 | 4/1986 |
| DE | 35 27 103 A1 | 10/1986 |
| DE | 42 23 908 A1 | 1/1994 |
| DE | 196 20 997 C2 | 11/1997 |
| EP | 0 551 976 B1 | 7/1993 |

* cited by examiner

*Primary Examiner*—Daniel J. Colilla
*Assistant Examiner*—Kevin D. Williams
(74) *Attorney, Agent, or Firm*—Laurence A. Greenberg; Werner H. Stemer; Ralph E. Locher

(57) ABSTRACT

A device for registering the position of a printing plate on the plate cylinder of a printing machine includes sensors responsive to being covered by the printing plate, the sensors being provided on one of the plate cylinder and an attachment device of the plate cylinder, respectively.

15 Claims, 4 Drawing Sheets

DEVICE FOR REGISTERING A PRINTING PLATE POSITION

BACKGROUND OF THE INVENTION

FIELD OF THE INVENTION

The invention relates to a device for registering a printing plate position on the cylinder of a rotary printing machine.

The published European Patent Document EP 0 551 976 B1, for example, discloses the provision of electrically conductive stops for a printing plate, which, when the printing plate is resting precisely on the stops, complete a circuit via the electrically conductive printing plate and, in this manner, indicate the precise positioning of the printing plate.

SUMMARY OF THE INVENTION

It is accordingly an object of the invention to provide a device for registering a printing plate position that operates without electrically conductive stops.

With the foregoing and other objects in view, there is provided, in accordance with the invention, a device for registering the position of a printing plate on the plate cylinder of a printing machine, comprising sensors responsive to being covered by the printing plate, the sensors being provided on one of the plate cylinder and an attachment device of the plate cylinder, respectively.

In accordance with another feature of the invention, the sensors are inductively operating coil arrays.

In accordance with an alternative feature of the invention, the sensors are capacitively operating capacitor arrays.

In accordance with another feature of the invention, the sensors have a thickness of about 0.1 mm.

In accordance with a further feature of the invention, the sensors are arranged in a region of stops which cooperate with the printing plate.

In accordance with an added feature of the invention, the stops are disposed on a clamping bar, and the sensors are disposed opposite to stops.

In accordance with an additional feature of the invention, the stops are disposed in a lower clamping strip of the clamping bar, and the sensors are disposed on an upper clamping strip thereof.

In accordance with yet another feature of the invention, the sensors are disposed in the vicinity of the stops and so as to cooperate with an edge of the printing plate.

In accordance with yet a further feature of the invention, the sensors are disposed so as to cooperate with stamped-out portions of the printing plate.

In accordance with yet an added feature of the invention, the sensors are disposed at intervals spaced from one another and so as to cooperate with a leading edge of the printing plate, and there is included an additional sensor disposed so as to cooperate with a side edge of the printing plate.

In accordance with yet an additional feature of the invention, the sensors are disposed so as to cooperate with stamped-through portions of the printing plate, one of the sensors being disposed in the axial direction of the plate cylinder for cooperating with one of the stamped-through portions.

In accordance with still another feature of the invention, one of the sensors is disposed so as to cooperate with a stamped-through portion of the printing plate, the one sensor cooperating with the stamped-through portion, the one sensor and a further sensor being disposed offset at an angle from one another.

In accordance with still a further feature of the invention, the offset angle is 120°.

In accordance with still an added feature of the invention, the fastening device is a clamping bar, and the sensors are embedded in one of the plate cylinder and the clamping bar thereof, respectively.

In accordance with an alternative feature of the invention, the fastening device is a clamping bar, and the sensors are adhesively bonded to one of the plate cylinder and the clamping bar thereof, respectively.

In accordance with still an additional feature of the invention, the sensors are capable of feeding electrical signals corresponding to the position of the printing plate to a control computer.

In accordance with a concomitant feature of the invention, the electrical signals serve for correcting the register of the printing plate.

A particular advantage of the invention is that the detection of the position of the printing plate can be established without contact with the sensor element. Soiling or wear of the sensors arranged in accordance with the invention are thus of lesser importance, as a result of which high quality is achieved in registering the printing plate position.

In a further development of the invention, it is possible to dispense completely with conventional stops.

Particularly advantageous is a construction of the sensors as inductively operating coil arrays, or, in order to register nonferrous printing plates, a construction of the sensors as capacitively operating capacitor arrays. The proposed sensors can have a relatively slight thickness of, for example, about 0.1 mm, and are therefore also suitable for the retrofitting of the plate cylinder.

Other features which are considered as characteristic for the invention are set forth in the appended claims.

Although the invention is illustrated and described herein as embodied in a device for registering a printing plate position, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
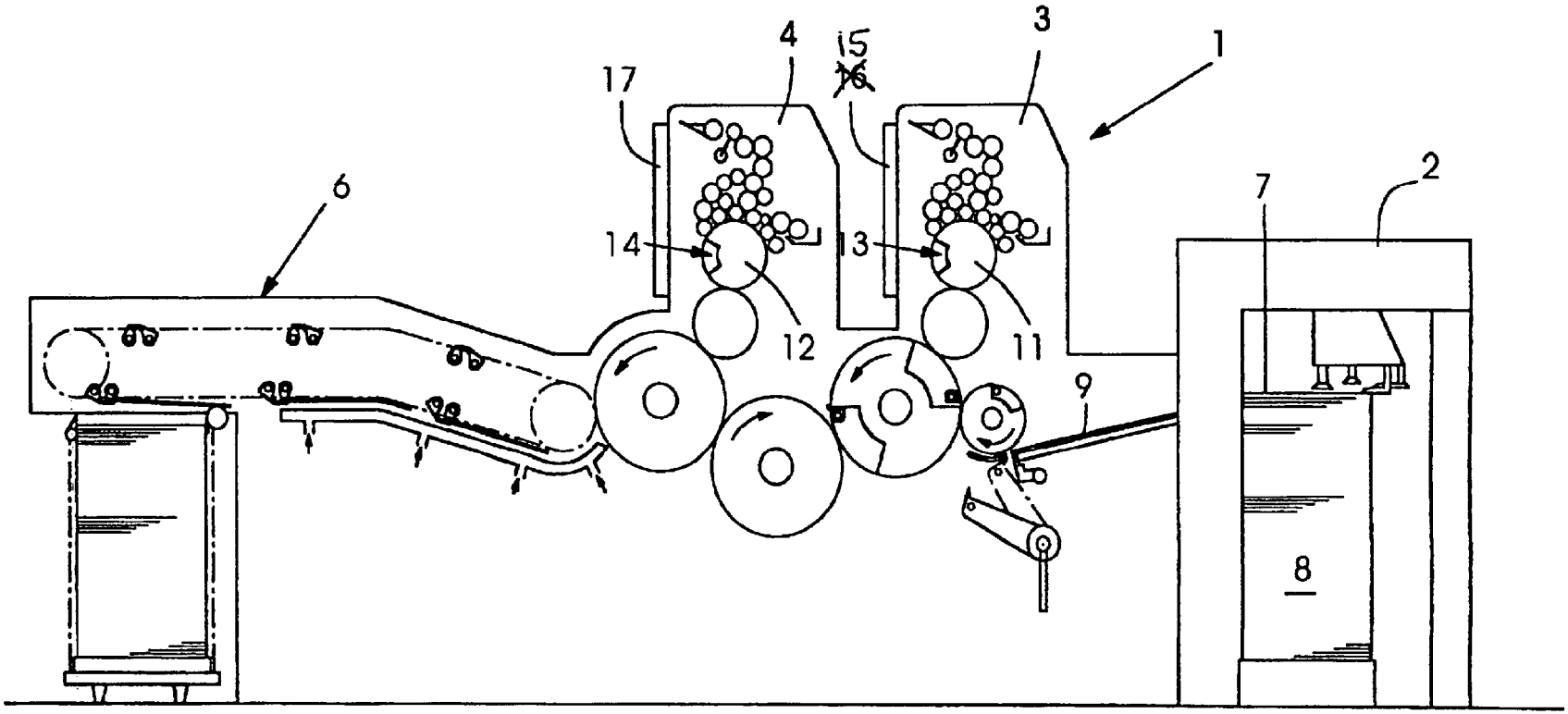
FIG. 1 is a diagrammatic side elevational view of a sheet-fed rotary printing machine.

Referring now to the drawings and, first, particularly to FIG. 1 thereof, there is shown therein a rotary printing machine, for example, a sheet-processing printing machine 1, having a feeder 2, at least one printing unit 3 or 4 and a delivery 6. Sheets are removed from a sheet pile 8 and fed singly, i.e., separately, or in an imbricated formation over a feed table 9 to the respective printing unit or units 3 and 4. The latter are provided, in a conventional manner, with respective plate cylinders 11 and 12. The plate cylinders 11 and 12, respectively, have a device 13 and 14, respectively, for affixing flexible printing plates 16 thereon. Furthermore, a device 15, 17 for semiautomatically or fully automatically changing printing plates is assigned to each plate cylinder 11, 12.

Figure 3:
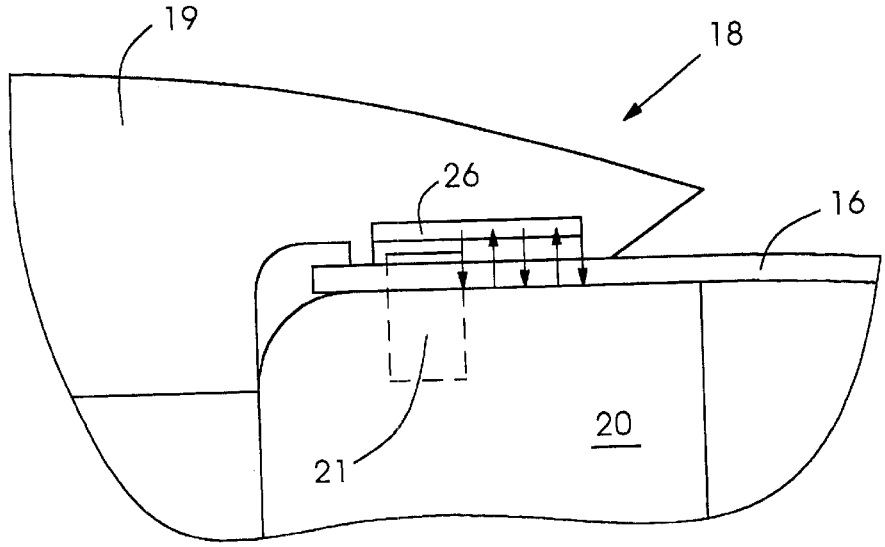
FIG. 3 is an enlarged fragmentary view of FIG. 2, rotated clockwise through approximately 60°, showing a retainer region of a clamping rail on the plate cylinder, with a sensor arrangement in accordance with the invention.

In the exemplary embodiment shown in FIG. 3, this printing-plate affixing device 13, 14 includes a respective clamping bar 18 that has a fixed, upper clamping strip 19 and a movable, lower clamping strip 20.

Figure 4:
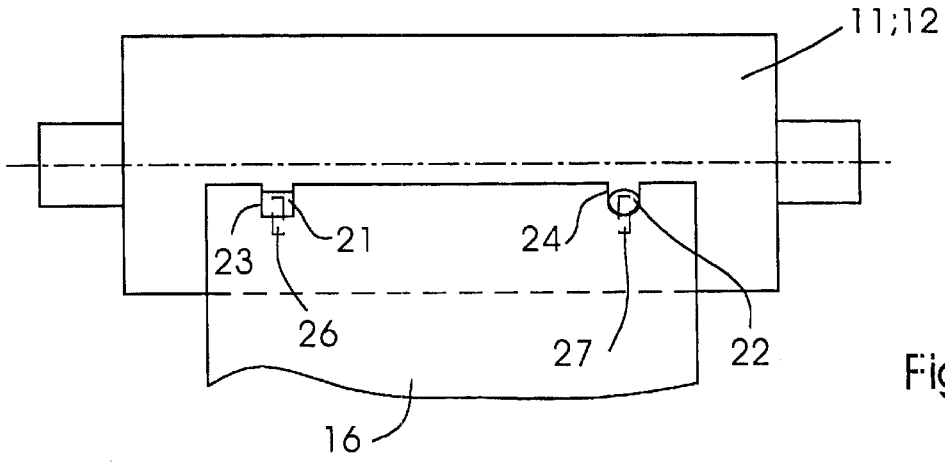
FIG. 4 is a diagrammatic plan view of a first exemplary embodiment of the sensor arrangement in accordance with the invention illustrated in FIG. 3.

In the retaining region for the printing plate 16 formed by the clamping strips 19 and 20, respective stops 21 and 22 are provided in accordance with the exemplary embodiment of FIG. 4, the stops 21 and 22 cooperating with respective stamped-out portions 23 and 24 on the leading edge of the printing plate 16. The stops 21 and 22 are adjustably disposed on the lower clamping strip 20. A respective sensor 26, 27, for example, in the form of an inductively operating coil array or a capacitively operating capacitor array, functioning as a printing-plate registering device, is disposed precisely opposite the stops 21 and 22, respectively, in the underside of the upper clamping strip 19.

The sensors 26 and 27, respectively, have a thickness of about 0.1 mm and are embedded in or adhesively bonded to the clamping strip 19.

The printing plates 16 are formed, at least in the registration region of the sensors 26 and 27, of electrically conductive, particularly ferromagnetic, material. The stops 21 and 22 are formed of electrically nonconductive material, for example, plastic or ceramic material.

The sensors 26 and 27 are disposed in the region of the stamped-out portions 23 and 24, respectively, of the printing plate 16, so that a defined part of the beginning region of the printing plate 16 covers the respective sensors 26 and 27. Depending upon the extent of coverage, an electrical signal of corresponding intensity is supplied to a control computer 28, which signals the precise or faulty contact between the printing plate 16 and the stops 21 and 22. Of course, the exact position of the printing plate can also be determined from the electrical signals, so that a register correction can be performed using non-illustrated, suitable conventional register adjusting devices.

For the installation of electrically nonconductive printing plates, the use of the capacitively operating capacitor arrays is proposed.

Figure 5:
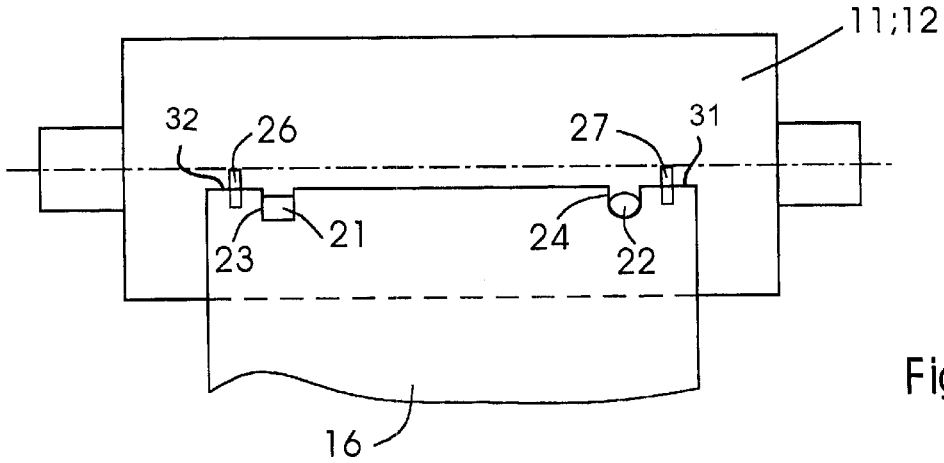
FIG. 5 is a view like that of FIG. 4 showing a second exemplary embodiment of the sensor arrangement, with stops.

A further arrangement of the sensors 26 and 27 for detecting the printing plate position is illustrated in FIG. 5. The sensors 26 and 27 are located in the vicinity of the stops 21 and 22, respectively, preferably at locations outside thereof, in the region of the leading edge of the printing plate 16, which at least partially covers the sensors 26 and 27. Here, at least in the registration region of the sensors 26 and 27, the leading edge of the printing plate 16 should have a precisely stamped-out edge 31 and 32, respectively.

In this regard, the sensors 26 and 27 are attached either to the underside of the upper clamping strip 19 or to the upper side of the lower clamping strip 20.

In order to increase the accuracy of registration of the printing plate position, the sensors 26 and 27 can be arranged opposite one another both on the upper and on the lower clamping strips 19 and 20, respectively. By this measure, it is possible for a wavy printing-plate leading edge to be registered particularly well.

Figure 6:
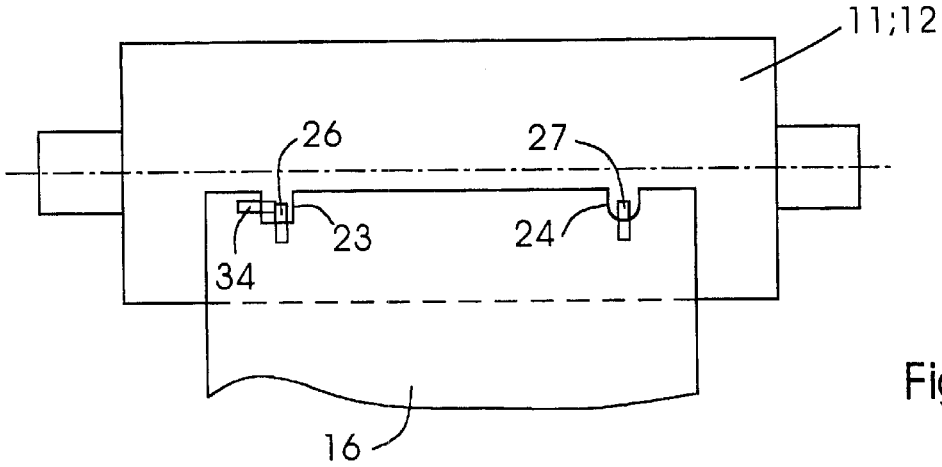
FIG. 6 is a view like those of FIGS. 4 and 5 showing a third exemplary embodiment of the sensor arrangement, without stops.

In the exemplary embodiments according to FIGS. 6, 7, 8 and 9, provision is made for dispensing with stops for the printing plates. Here, only sensors 26 and 27 for registering the printing plate position are used. A particularly favorable arrangement is shown in FIG. 6 wherein the sensors 26 and 27 are arranged in the region of the precisely finished stampings 23 and 24, respectively. A third sensor 34 registers the lateral position of the printing plate 16 in the respective stamping 23 or 24 or at the lefthand or righthand printing-plate side edge.

Figure 7:
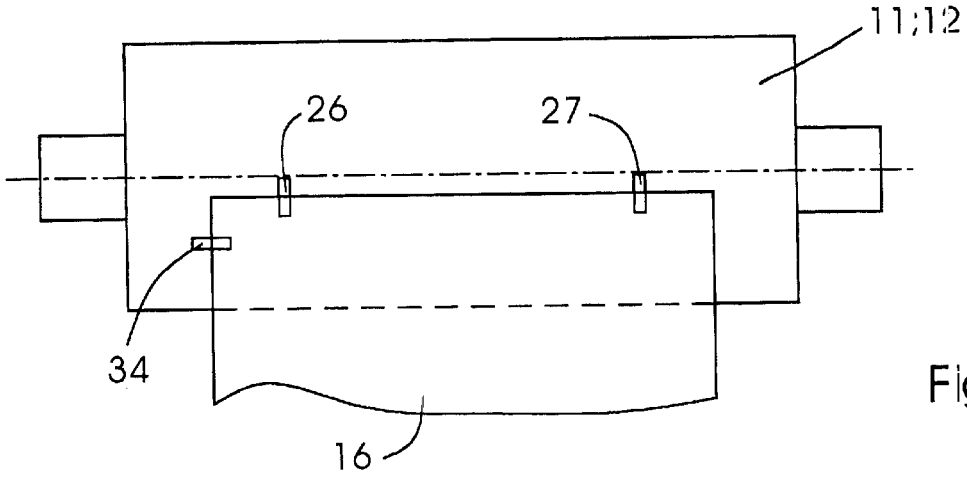
FIG. 7 is a view like those of FIGS. 4, 5 and 6 showing a fourth exemplary embodiment of the sensor arrangement, without stops.

In the exemplary embodiment according to FIG. 7, provision is made for arranging the sensors 26 and 27 at spaced intervals from one another in the region of the precisely stamped printing-plate leading edge and, in addition, for arranging a third sensor 34 at the precisely stamped lefthand or righthand printing-plate side edge in order to register the lateral position of the printing plate 16.

Figure 8:
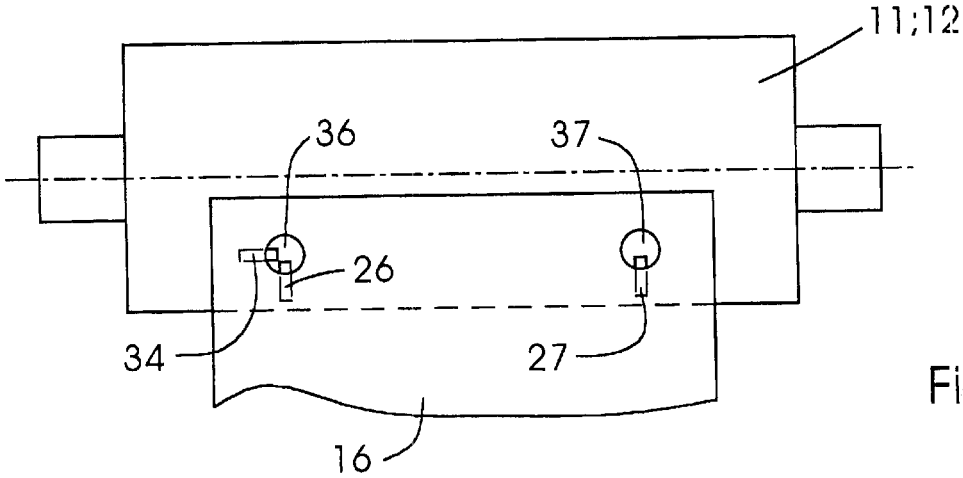
FIG. 8 is a view like those of FIGS. 4 to 7 showing a fifth exemplary embodiment of the sensor arrangement, without stops.
Figure 9:
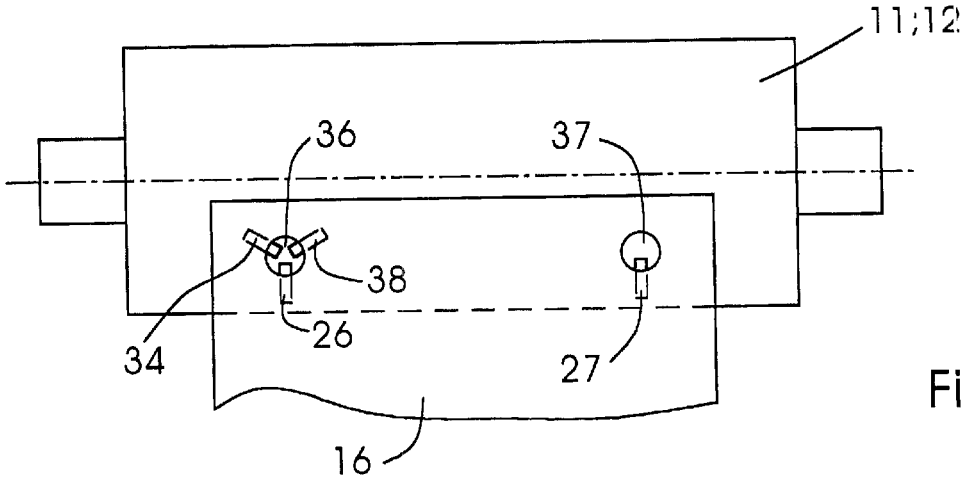
FIG. 9 is a view like those of FIGS. 4 to 8 showing a sixth exemplary embodiment of the sensor arrangement, without stops.

FIG. 8 shows a very simple embodiment of the invention. In this regard, precise stamping of the edge of the printing plate can be dispensed with. It is necessary to provide only two precisely stamped-through portions 36 and 37 spaced apart from one another. The sensors 26 and 27 are attached directly to the plate cylinder 11; 12 or the clamping rail 18 in the region wherein the printing plate 16 is attached. In this regard, part of the sensors 26 and 27 extends into the respective stamped-through portions 36 and 37, and a further part is covered by the printing plate 16. The sensors 26 and 27 are thereby aligned in the circumferential direction of the respective plate cylinder 11 or 12. The third sensor 34 for detecting the lateral position is aligned in the axial direction and extends either into the respective lefthand and righthand stamped-through portions 36 and 37.

In order to increase the measurement accuracy, three or more sensors 26 or 27 can also be provided. While the sensor 27 that cooperates with the stamped-through portion 37 is aligned, for example, in the circumferential direction, the sensors 26, 34 and 38 are arranged at a mutual angular spacing of 120°, one part, respectively, extending into the stamped-through portion 36.

Figure 2:
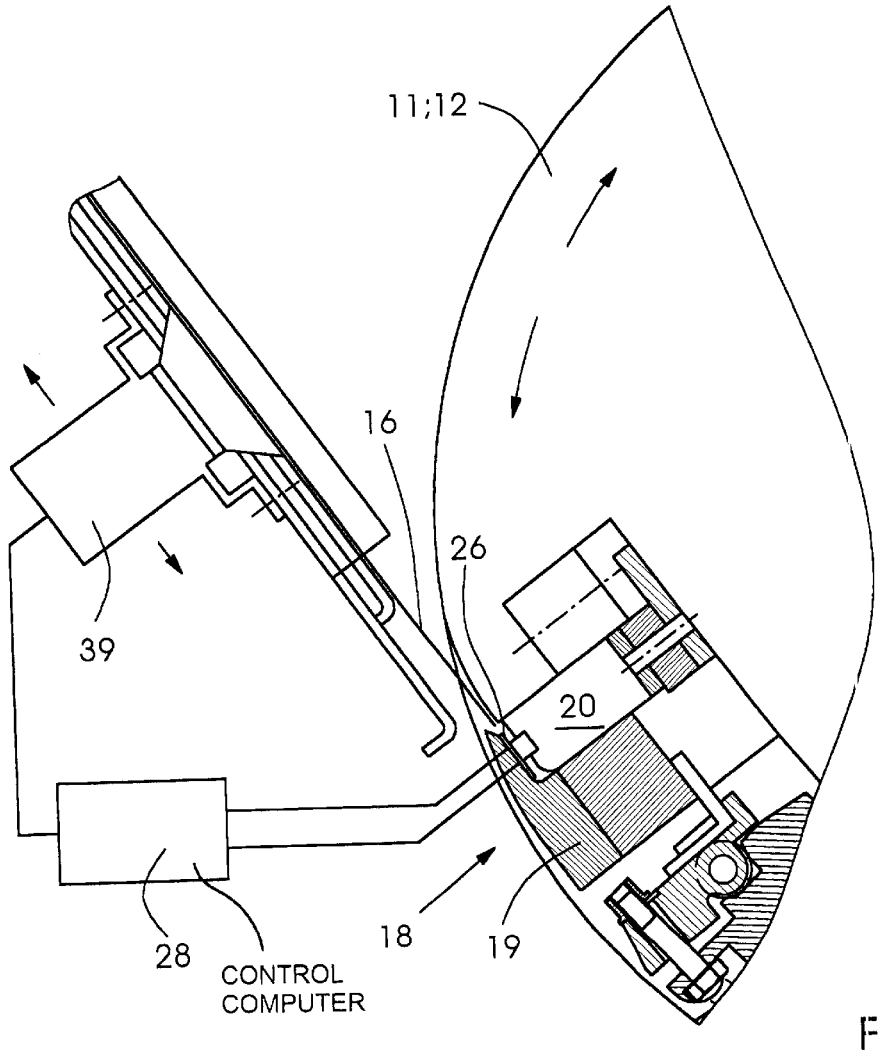
FIG. 2 is a fragmentary diagrammatic and schematic side elevational view of a plate cylinder in a feed position wherein a printing plate is fed onto it.

If sensors 26, 27; 34; 38 are used, while the stops 21 and 22 for the printing plate 16 are dispensed with, provision is made for a printing-plate feeder, for example, in the form of a movable sucker 39 (note FIG. 2) or non-illustrated driven transport rollers, for feeding the printing plate 16 to the plate cylinder 11 or 12 or to the clamping device, until a signal confirming the positional accuracy of the printing plate 16 is fed to the control computer 28. The latter immediately stops the plate feed at the predetermined position, so that clamping in exact register can be performed. The stamped-through portions 36 are preferably round. However, they may also have oval, triangular, square or other polygonal shapes.

We claim:

1. A device for registering the position of a printing plate on the plate cylinder of a printing machine, comprising:

non-contacting sensors responsive to being covered by a printing plate, said sensors being disposed for cooperating with stamped-out portions of the printing plate and said sensors being provided on one of the plate cylinder and an attachment device of the plate cylinder, respectively.

2. The registering device according to claim 1, wherein said sensors are inductively operating coil arrays.

3. The registering device according to claim 1, wherein said sensors are capacitively operating capacitor arrays.

4. The registering device according to claim 1, wherein said sensors have a thickness of about 0.1 mm.

5. The registering device according to claim 1, wherein said sensors are arranged in a region of stops which cooperate with the printing plate.

6. The registering device according to claim 5, wherein said stops are disposed on a clamping bar, and said sensors are disposed opposite to said stops.

7. The registering device according to claim 6, wherein said stops are disposed in a lower clamping strip of said clamping bar, and said sensors are disposed on an upper clamping strip thereof.

8. The registering device according to claim 1, wherein said sensors are disposed in the vicinity of said stops and so as to cooperate with an edge of the printing plate.

9. The registering device according to claim 1, wherein said sensors are disposed so as to cooperate with stamped-through portions of the printing plate, one of said sensors being disposed in the axial direction of the plate cylinder for cooperating with one of said stamped-through portions.

10. The registering device according to claim 1, wherein one of said sensors is disposed so as to cooperate with a stamped-through portion of the printing plate, said one sensor cooperating with said stamped-through portion, said one sensor and a further sensor being disposed offset at an angle from one another.

11. The registering device according to claim 10, wherein said offset angle is 120°.

12. The registering device according to claim 1, wherein said attachment device is a clamping bar, and said sensors are embedded in one of the plate cylinder and said clamping bar thereof, respectively.

13. The registering device according to claim 1, wherein said attachment device is a clamping bar, and said sensors are adhesively bonded to one of the plate cylinder and said clamping bar thereof, respectively.

14. The registering device according to claim 1, wherein said sensors are capable of feeding electrical signals corresponding to the position of the printing plate to a control computer.

15. The registering device according to claim 14, wherein said electrical signals serve for correcting the registering of the printing plate.

* * * * *

UNITED STATES PATENT AND TRADEMARK OFFICE

CERTIFICATE OF CORRECTION

PATENT NO. : 6,845,713 B1
DATED : January 25, 2005
INVENTOR(S) : Frank Schumann et al.

It is certified that error appears in the above-identified patent and that said Letters Patent is hereby corrected as shown below:

Title page,
Item [73], Inventor, should read as follows:
-- Heidelberger Druckmaschinen AG, Heidelberg (DE) --

Signed and Sealed this

Twenty-second Day of March, 2005

JON W. DUDAS
*Director of the United States Patent and Trademark Office*